US010935204B2

(12) United States Patent
Hess

(10) Patent No.: US 10,935,204 B2
(45) Date of Patent: Mar. 2, 2021

(54) LIGHTING DEVICE FOR VEHICLES HAVING AN ADAPTOR MOUNTING A LENS TO A VEHICLE LAMP HOUSING AT THE PERIPHERY THEREOF

(71) Applicant: HELLA GmbH & Co. KGaA, Lippstadt (DE)

(72) Inventor: Rainer Hess, Zellerndorf (AT)

(73) Assignee: HELLA GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/490,198

(22) PCT Filed: Jan. 31, 2018

(86) PCT No.: PCT/DE2018/100072

§ 371 (c)(1),
(2) Date: Aug. 30, 2019

(87) PCT Pub. No.: WO2018/161989

PCT Pub. Date: Sep. 13, 2018

(65) Prior Publication Data

US 2020/0011499 A1 Jan. 9, 2020

(30) Foreign Application Priority Data

Mar. 8, 2017 (DE) ..... 10 2017 104 838

(51) Int. Cl.
*F21S 41/29* (2018.01)
*F21S 41/20* (2018.01)

(52) U.S. Cl.
CPC ..... *F21S 41/29* (2018.01); *F21S 41/28* (2018.01)

(58) Field of Classification Search
CPC ..... F21S 41/29; F21S 41/295; F21S 41/28
See application file for complete search history.

(56) References Cited

U.S. PATENT DOCUMENTS 6,059,433 A * 5/2000 Otaka ..... F21S 41/19 362/507
2001/0040811 A1 11/2001 Chase et al.
2005/0024888 A1* 2/2005 Otani ..... B29C 65/1635 362/514

FOREIGN PATENT DOCUMENTS

DE 4128534 C1 * 2/1993 ..... B60Q 1/0483
DE 102007010211 A1 9/2008
DE 102013101024 A1 8/2014
EP 1270319 A2 1/2003
EP 1479563 A1 11/2004
EP 1637801 A2 3/2006
(Continued)

OTHER PUBLICATIONS

English translation of the International Preliminary Report on Patentability dated Sep. 19, 2019, in International Application No. PCT/DE2018/100072.

(Continued)

*Primary Examiner* — Robert J May
(74) *Attorney, Agent, or Firm* — Patent Central LLC; Stephan A. Pendorf

(57) ABSTRACT

A lighting device for vehicles, including a housing, in which light-technical components are arranged, and a cover lens that closes an opening of the housing, wherein the cover pane is connected to the housing via an adapter part that is arranged on a peripheral edge of said cover lens.

5 Claims, 4 Drawing Sheets

(56) References Cited

FOREIGN PATENT DOCUMENTS

Figure 1:
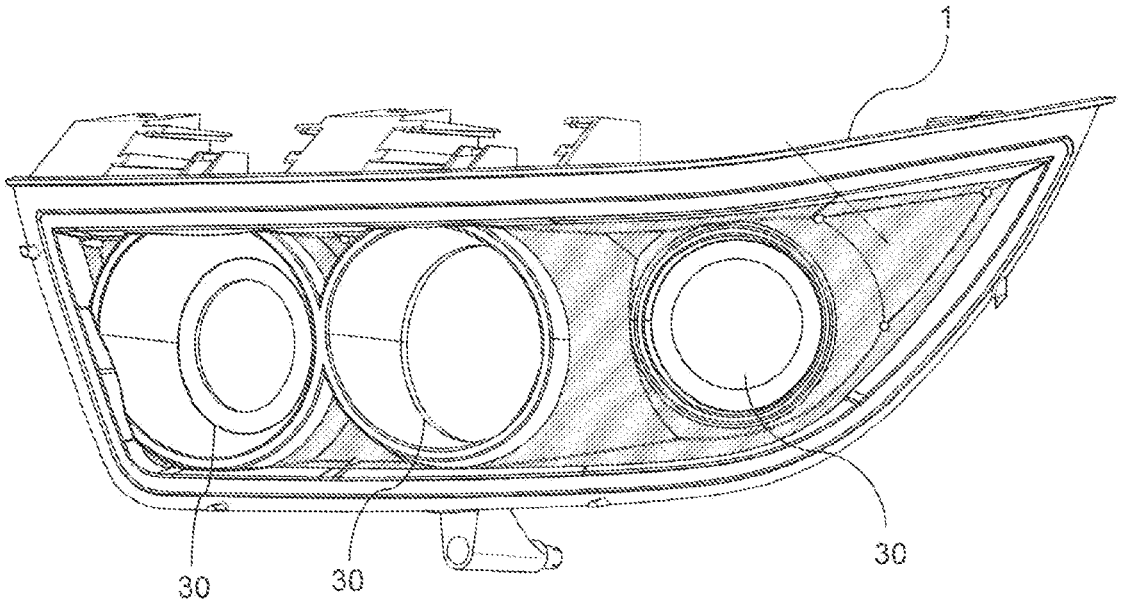

| | | | |
|---|---|---|---|
| FR | 2459938 | A1 | 1/1981 |
| WO | 2015044755 | A1 | 4/2015 |

OTHER PUBLICATIONS

International Search Report dated May 7, 2018, in International Application No. PCT/DE2018/100072.

* cited by examiner

LIGHTING DEVICE FOR VEHICLES HAVING AN ADAPTOR MOUNTING A LENS TO A VEHICLE LAMP HOUSING AT THE PERIPHERY THEREOF

The invention relates to a lighting device for vehicles with a housing in which lighting components are arranged and with a cover lens which closes off an opening in the housing.

The invention further relates to a method for mounting a light-transmitting cover lens on a housing of a lighting device for vehicles, one fastening region being connected via a sealant and/or adhesive to another fastening region, such that, after a sealant and/or adhesive curing time, the cover lens is firmly connected to the housing.

A lighting device for vehicles with a housing, in which a plurality of lighting components, such as for example a light source, reflectors, lenses and/or diaphragms are arranged is known from DE 10 2007 010 211 A1. The housing is of cup-shaped configuration and has an opening which is covered by a transparent cover lens. The cover lens is fastened at the edge to an edge of the housing, wherein an edge projection of the cover lens is inserted into a groove, which is at least partially filled with a sealant/adhesive, of the housing edge. Once the sealant/adhesive has cured, the cover lens is firmly connected to the housing. In currently manufactured passenger cars, the cover lens is generally produced from a plastics material, thus reducing the weight of the lighting device. If the vehicle is an agricultural vehicle (e.g. a tractor), it is generally desired for the cover lens to be made from a glass material due to the high level of mechanical stresses to which the lighting device is exposed. Furthermore, it is desirable to accommodate as many lighting functions as possible within the housing, for example low beam, high beam, daytime running light, and working light. In addition to the lighting components, such as light sources, reflectors, light guides and diaphragm parts, these also include adjusting means, heat sinks, and control electronics. Since the cover lens can only have a limited height, it is desirable to make the housing as high as possible to permit integration of all the lighting components.

Thus, the object of the present invention is to provide a lighting device for vehicles and a method for mounting a light-transmitting cover lens on the housing such that, given a predetermined size of a cover lens, the latter covers a housing opening of the greatest possible size, wherein a secure and durable connection is created between the cover lens and the housing.

In order to achieve said object, the invention associated with the preamble of claim 1 is characterized in that the cover lens is connected to the housing via an adapter part arranged on a circumferential edge of said cover lens.

The invention provides an adapter part, by means of which a cover lens is connected to an opening edge of a housing of the lighting device. The cover lens is thus not directly connected to the housing. The adapter part is configured such that it can be connected on the one hand to the cover lens and on the other hand to an edge of the housing. The adapter part thus forms a "bridge" between the cover lens and the housing, wherein it is configured to ensure optimum fastening thereof to the cover lens on the one hand and to the housing on the other hand. Fastening of the cover lens, which preferably consists of a glass material, to the housing, which preferably consists of a plastics material, can thus be optimized. The adapter part may furthermore be used to increase the opening area of the housing and thus also the size of the housing, since the cover lens must not rest on any contact surface of the housing which extends in the opening area of the housing. Advantageously, the installation space available in the housing for receiving lighting components and further control and adjusting means can be increased in this manner.

According to a preferred embodiment of the invention, the adapter part is connected in an inner fastening region to the cover lens and in an outer fastening region to the housing. The opening edge or opening of the housing may advantageously be increased in size, which results in greater installation space in the housing while the cover lens remains the same size. It is here accepted that an area of the light opening is smaller than an area of the housing opening. Such a difference in size results from an edge of the cover lens resting against the inner fastening region of the adapter part and thus covering an edge strip, which stands out inwardly from a housing wall, of the housing opening.

According to a further development of the invention, the adapter part has a base surface from which, in the outer fastening region, an edge projection projects which engages in a groove, provided in and at least partially filled with sealant and/or adhesive, of the housing. The sealant and/or adhesive forms an adhesive bed for the edge projection, in which the majority of the length of the latter is immersed, such that, once the sealant and/or adhesive has cured, the adapter part is firmly connected to the housing.

According to a further development of the invention, the adapter part has, in the inner fastening region thereof, a channel extending in a circumferential direction for receiving a sealant and/or adhesive, by means of which the adapter part is connected to an edge of the cover lens. The channel makes it possible for the sealant and/or adhesive to be received in its liquid or high-viscosity initial state. The sealant and/or adhesive is thus prevented from undesirably flowing away prior to the curing thereof.

According to a further development of the invention, an edge of the cover lens is fixable to the adapter part, in an inner fastening region thereof, to a side remote from the housing or to a side facing the housing. The adapter part thus always has a contact surface or receiving surface for the sealant/adhesive, wherein the edge of the cover lens or a peripheral edge of the cover lens must be at no greater distance from a central plane of the housing than an inner side of the housing or housing edge from the central plane. If the adapter part is connected firstly to the cover lens, a cover unit is formed which is fixable to the edge of the housing. A width of the adapter part in the inner fastening region thereof establishes how much greater the size of the housing opening can be than the size of the light opening.

According to a further development of the invention, the adapter part is formed as an adapter frame which is formed to follow the outline of the edge of the cover lens. Advantageously, the housing interior is better sealed-off from its surroundings due to the double connection or double sealant/adhesive seam.

According to a further development of the invention, the adapter part is formed as an unreinforced plastics injection molding. The cover lens is produced from a glass material, in particular a toughened glass material. Manufacturing tolerances of the cover lens can advantageously be compensated, since the adapter part can "adapt" during mounting on the cover lens to the arcuate edge thereof. The adapter part, which is yielding to a limited extent during mounting, can follow the outline of the relatively hard cover lens.

In order to achieve the object, the invention associated with a further embodiment is characterized in that in a first step a first fastening region of the cover lens is connected at the edge to a second fastening region of a peripheral adapter part via a first sealant and/or adhesive and in that it is only once the connection process of the cover lens to the adapter part is complete that a third fastening region of a cover unit firmly formed from the cover lens and the adapter part is connected via a second sealant and/or adhesive to a fourth fastening region of the housing.

According to the invention, a cover lens is mounted on a housing in two stages. In a first step, the cover lens is connected to an adapter part via a first sealant and/or adhesive. It is only once the connection process is fully complete, in particular once the first sealant and/or adhesive has cured, that the cover lens and adapter part, which are firmly connected to one another and form a cover unit, are connected to an edge of the housing via a second sealant and/or adhesive. A secure connection between the cover lens and the housing is advantageously achieved in this manner, wherein the cover lens adheres durably and sealingly to the housing. The two-stage nature of the connection improves process reliability during production. The double connection seam (first sealant and/or adhesive, second sealant and/or adhesive) seals the housing interior particularly effectively from its surroundings.

According to a further development of the method according to the invention, the adapter part is produced from an unreinforced plastics material by injection molding such that, upon connection to the cover lens, the adapter part can adapt to the outline of the cover lens. The rigidity of the adapter part is sufficiently low to allow cover lens tolerances to be compensated. A secure and very well sealed connection is advantageously created in this manner.

According to a further development of the invention, the cover lens is produced from a glass material, in particular a toughened glass material. A lighting device which can be exposed to a high level of mechanical stresses is advantageously created in this manner. The lighting device can advantageously be used for farm machinery or agricultural vehicles.

Figure 2:
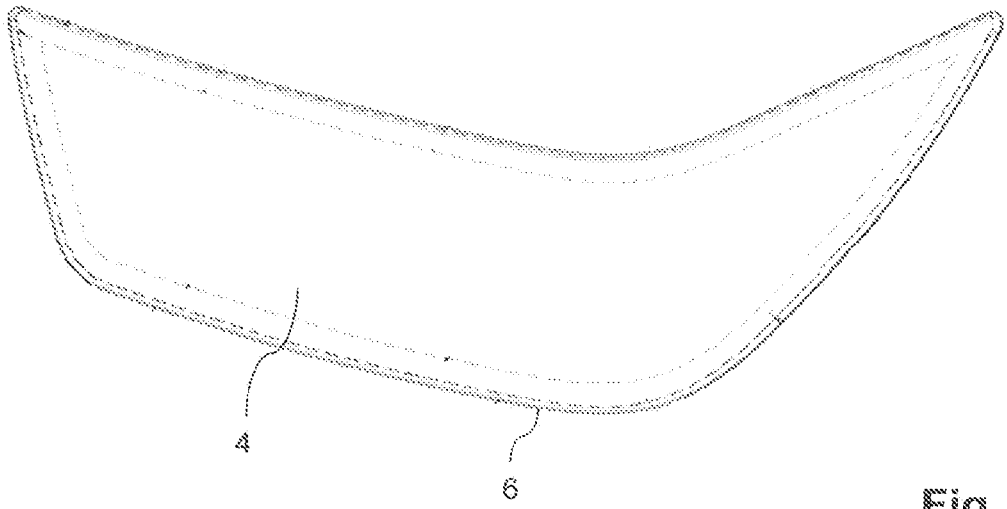
Figure 3:
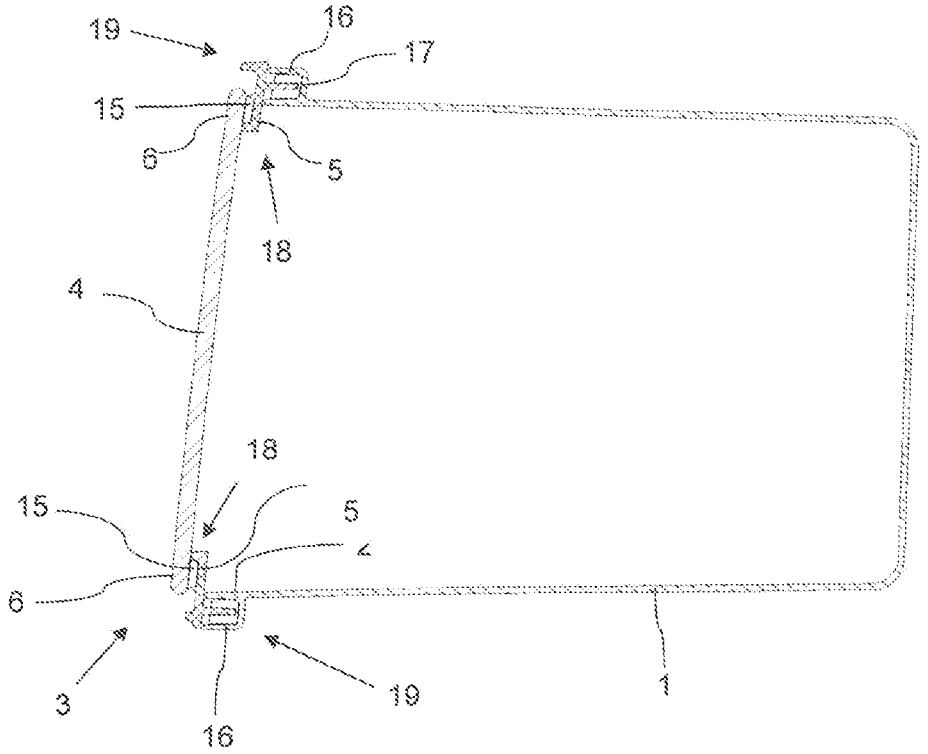
Figure 4:
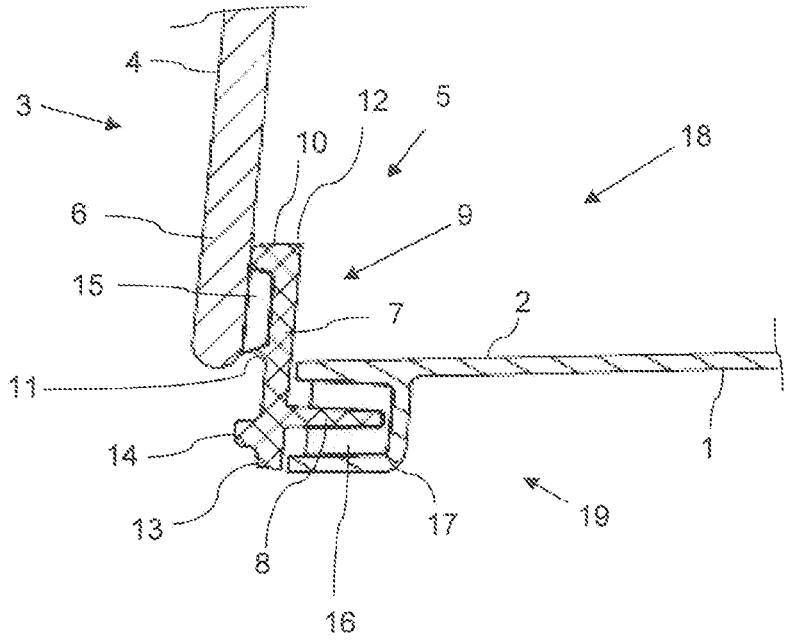
Figure 5:
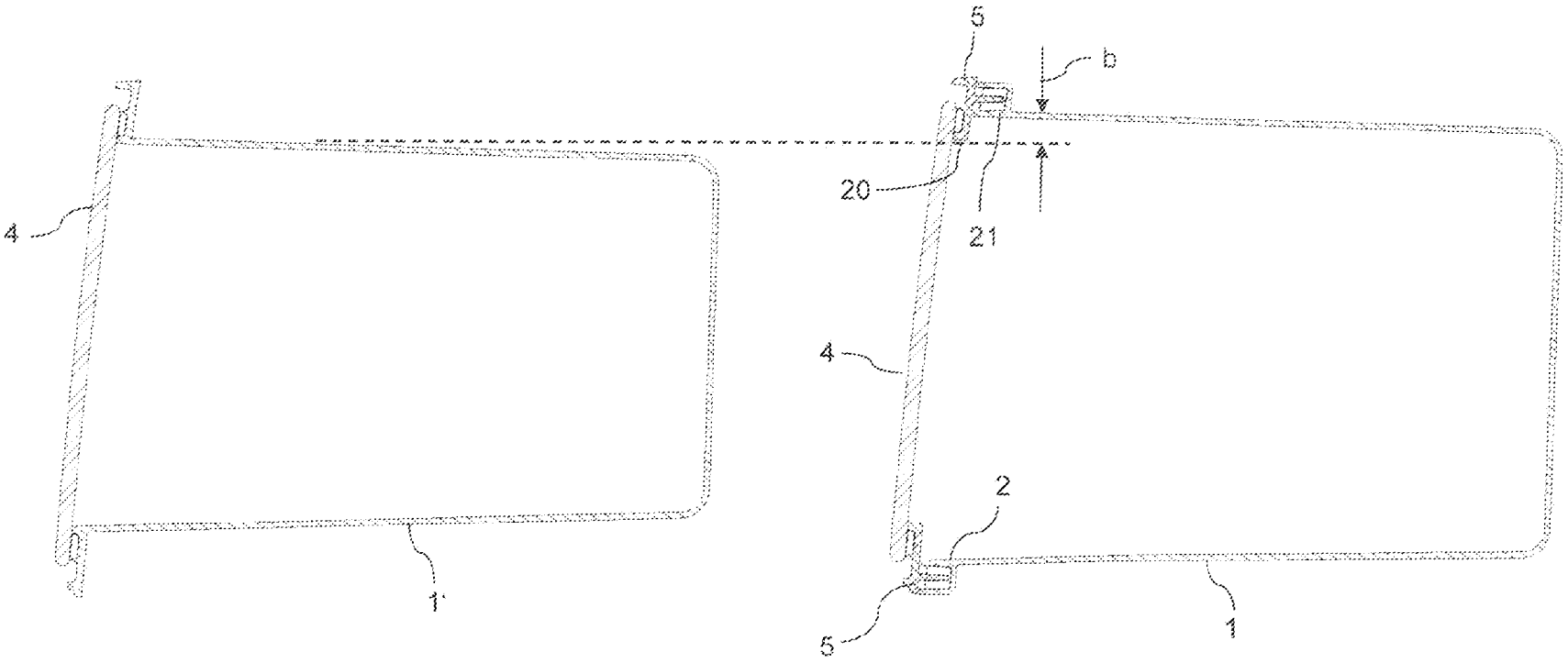
Figure 6:
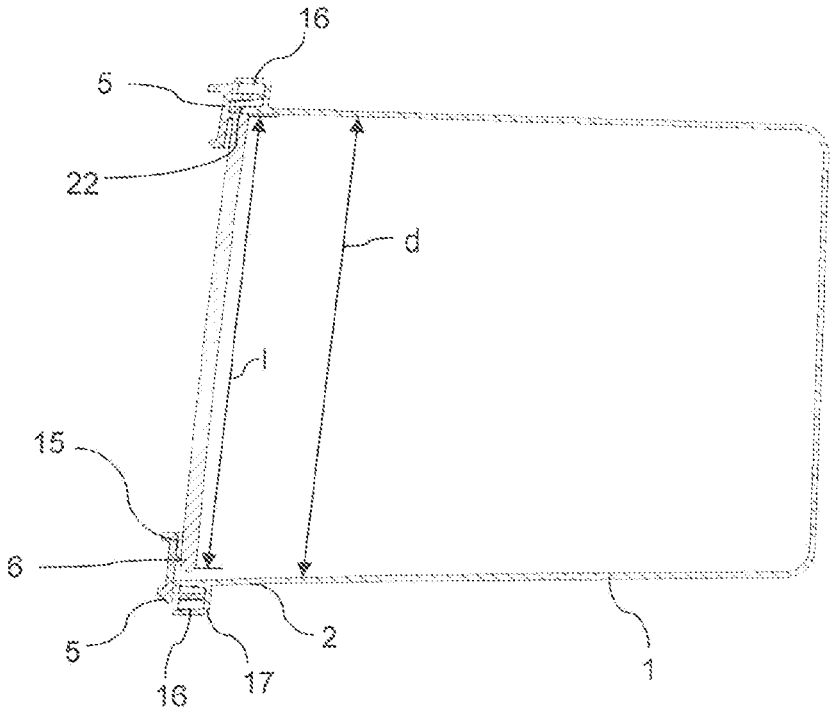

Exemplary embodiments of the invention are explained in more detail below with reference to the drawings, in which:

FIG. 1 shows a perspective front view of a lighting device,

FIG. 2 shows a perspective front view of a cover lens of the lighting device, FIG. 3 shows a vertical section through a housing covered by the cover lens according to a first embodiment of the invention, FIG. 4 shows a magnified vertical section in a lower connection region between the cover lens and the housing according to FIG. 3, FIG. 5 shows a vertical section through a known housing and the housing according to FIG. 3 covered according to the invention to illustrate the enlargement of the housing installation space and FIG. 6 shows a vertical section through a housing covered by the cover lens according to a second embodiment of the invention.

A lighting device for vehicles is preferably used as a headlamp in agricultural vehicles, in particular tractors.

The headlamp has a housing 1 which is of cup-shaped configuration. The housing 1 has an edge 2 which surrounds an opening thereof. The opening of the housing 1 is covered by a cover unit 3.

Lighting components, such as for example a number of light sources, a number of reflectors, lenses, heat sinks, adjusting means for adjusting lighting components and control electronics, are accommodated within the housing 1. For example, a carrying frame which carries the lens and/or reflector is mounted adjustably about a horizontal axis, such that the headlamps can be leveled by means of the adjusting means. The housing may contain a plurality of lighting modules 30 for producing low beam, high beam, daytime running and working light.

The cover unit 3 has a transparent cover lens 4 and an adapter part 5 which is preferably of frame-shaped configuration. The adapter part 5 in the form of an adapter frame is formed to follow the outline or an edge 6 of the cover lens 4.

The adapter frame 5 has a substantially planar base surface 7, from which an edge projection 8 projects from a side facing the housing 1. A channel 9, defined by a first raised portion 10 and a second raised portion 11, is provided on an opposing side, remote from the housing 1, of the base surface 7. The first raised portion 10 is arranged on an inner edge 12 of the base surface 7 or of the adapter frame 5. On an outer edge 13 of the adapter frame 5, a third raised portion 14 is arranged offset and parallel to the first raised portion 10 and the second raised portion 11. The first raised portion 10, the second raised portion 11 and the third raised portion 14 project out from a side, remote from the edge projection 8, of the base surface 7 of the adapter frame 5. The first raised portion 10, the second raised portion 11 and the third raised portion 14 thus extend from the base surface 7 in the opposite direction to the edge projection 8. The first raised portion 10 and the second raised portion 11 are in each case at a smaller distance from the inner edge 12 of the cover frame 5 than is the edge projection 8.

The channel 9 is thus substantially located at a smaller distance from the inner edge 12 of the adapter frame 5 than the edge projection 8.

In the present exemplary embodiment, the raised portions 10, 11, 14 and the edge projection 8, like the adapter frame 5, are formed continuously, i.e. without interruption, in the direction of extension of the adapter frame 5.

As is more readily apparent from FIG. 4, the edge 6 of the cover lens 4, which forms a first fastening region of the lighting device, is connected via a first sealant and/or adhesive 15 to the channel 9 of the adapter frame 5, wherein the channel 9 forms a second fastening region of the lighting device.

Once the connection process between the cover lens 4 and the adapter frame 5 is complete, namely once the first sealant and/or adhesive 15 has cured, the cover unit 3 is connected to the housing 1 in a second step. For this purpose, the edge projection 8 of the cover unit 3 is inserted into a groove 17, at least partially filled with a second sealant and/or adhesive 16, of the housing edge 2 and positioned in the mounting position. Once the second sealant and/or adhesive 16 has cured, the opening of the housing 1 is sealingly and adhesively closed by the cover unit.

As is apparent from FIG. 3, the edge 6 of the cover lens 4 is adhesively attached to a side, remote from the housing 1, of the adapter frame 5 or the base surface 7 thereof. The channel 9 which receives the first sealant and/or adhesive 15 is located on the side of the base surface 7 remote from the housing 1. The edge projection 8 or the base surface 7 of the adapter frame 5 form a third fastening region of the lighting device. The groove 17 of the housing 2 forms a fourth fastening region of the lighting device. Four fastening regions 6, 8, 9, 17 are thus provided for mounting or fixing the cover lens 4 on the housing 1.

As is apparent from FIGS. 3 and 4, the first fastening region 6 and the second fastening region 9 or the first sealant and/or adhesive 15 are arranged in an inner fastening region 18 of the adapter frame 5, while the third fastening region 8 and the fourth fastening region 17 or the second sealant and/or adhesive 16 are arranged in an outer fastening region 19 of the adapter frame 5. The adapter frame 5 makes it possible to increase the size of the housing 1 while the cover lens 4 remains the same size, by the cover lens 5 being in the inner fastening region 18 and the connection to the housing 1 being made in the outer fastening region 19 of the adapter frame 5. FIG. 5 illustrates the difference from fastening the cover lens 4 without an adapter frame 5 according to the invention. In comparison with the known housing 1', the housing 1 may be configured to be higher by a width b, wherein the width b is defined by the distance between an inner peripheral edge 20 of the adapter frame 5 and an inner wall 21 of the groove 17 or wall of the housing 1.

Identical components or component functions are denoted with identical reference symbols in the figures.

According to an alternative embodiment of the invention according to FIG. 3, the cover lens 4 may also be connected to the adapter frame 5 on a side of the base surface 7 facing the housing 1. For this purpose, the first sealant and/or adhesive 15 is applied to the side of the base surface 7 facing the housing 1. On the side facing the housing 1, the base surface 7 thus forms a receiving surface for the first sealant and/or adhesive 15. In the present exemplary embodiment, an upper peripheral edge 22 of the cover lens 4 rests in places on an inner side of the housing 1. In order to increase the size of the installation space of the housing 1, the edge 6 of the cover lens 4 rests solely on the adapter frame 5, wherein the peripheral edge 22 of the cover lens 4 is positioned at a distance from the inner side of the housing 1 as illustrated in the lower region according to FIG. 6.

In the present exemplary embodiments, a longitudinal extent 1 of the cover lens 4 in the vertical and/or horizontal direction is less than or equal to a clear transverse extent d of the housing 1 at the edge 2 thereof. In contrast, the longitudinal extent 1 of the cover lens 4 according to the prior art had always to be larger than the clear transverse extent d of the housing 1.

The adapter frame 5 is preferably formed as an unreinforced plastics injection molding. The cover lens 4 is produced from a glass material, preferably a toughened glass material. Because the adapter part 5 consists of an unreinforced plastics material, it can adapt to the shape of the preferably curved outline of the cover lens 4. The separate connection between the cover lens 4 and the adapter part 4 via the first sealant and/or adhesive 15 to form the cover unit 3 also assists compensation of cover lens 5 tolerances.

The sealant and/or adhesive 16 preferably takes the form of a silicone adhesive.

The opening of the housing 1 or the cover lens 4 or the adapter part 5 may be of oval, rectangular or like configuration.

According to an alternative embodiment of the invention, the adapter part 5 may also firstly be connected to the housing 1 via the sealant and/or adhesive 16. Only thereafter is the resultant housing-adapter module connected to the cover lens 4 via the sealant and/or adhesive 15. The configuration of components 1, 4, 5 may here be the same as in the first embodiment. This procedure is thus the reverse of the procedure according to the first embodiment.

The invention claimed is:

1. A lighting device for vehicles with a housing (1) in which lighting components are arranged and with a cover lens (4) which has a first major surface facing the housing and a second major surface opposite the first major surface and which closes off an opening in the housing (1), wherein the cover lens (4) is connected to the housing (1) via an adapter part (5) arranged on a circumferential edge (6) of said cover lens, wherein the adapter part (5) has an inner fastening region (18) within the circumference of the opening of the housing (1) and an outer fastening region (19) outside the circumference of the opening of the housing (1), and wherein the adapter part (5) is connected at the inner fastening region (18) to a circumferential edge (6) of the first or second major surface of the cover lens (4) and at the outer fastening region (19) to an edge (2) of the opening of the housing (1), and wherein the adapter part (5) has a base surface (17) from which, in the outer fastening region (19) of the adapter part (5), an edge projection (8) projects which engages in a groove (17), provided with at least one of a sealant and adhesive (16), of the housing (1).

2. A method for mounting a light-transmitting cover lens (4) on a housing (1) of a lighting device for vehicles, wherein the cover lens (4) has a first major surface facing the housing and a second major surface opposite the first surface and is connected to the housing (1) via an adapter part (5) which has an inner fastening region (18) within the circumference of the opening of the housing (1) and an outer fastening region (19) outside the circumference of the opening of the housing (1), and wherein the adapter part (5) is connected at the inner fastening region (18) via at least one of a sealant and adhesive (15) to a circumferential edge (6) of the first or second major surface of the cover lens (4) and at the outer fastening region (19) via the at least one of a sealant and adhesive (16) to an edge (2) of the opening of the housing (1), the method comprising:

in a first step connecting the adapter part (5) at the inner fastening region (18) via at least one of a sealant and adhesive (15) to a circumferential edge (6) of the first or second major surface of the cover lens (4) and after the connection process of the cover lens (4) to the adapter part (5) is complete connecting the adapter part (5) at the outer fastening region (19) via the at least one sealant and adhesive (16) to an edge (2) of the opening of the housing (1), such that, after a time of curing the at least one of a sealant and adhesive (15, 16), the cover lens (4) is firmly connected to the housing (1).

3. The method according to claim 2, wherein the adapter pa (5) is produced from an unreinforced plastic material by injection molding and wherein, once the at least one of a sealant and adhesive (15) has cured, the adapter part (5) is connected to the housing (1) without the cover lens (4) coming into contact with the housing (1).

4. The method according to claim 2, wherein the cover lens (4) is produced from a glass material.

5. A lighting device for vehicles with a housing (1) in which lighting components am arranged and with a cover lens (4) which closes off an opening in the housing (1), wherein the cover lens (4) has a first major surface facing the housing and a second major surface opposite the first surface and is connected to the housing (1) via an adapter part (5), wherein the adapter part (5) has an inner fastening region (18) within the circumference of the opening of the housing (1) and an outer fastening region (19) outside the circumference of the opening of the housing (1), and wherein the adapter part (5) is connected at the inner fastening region (18) via at least one of a sealant and adhesive (15) to a circumferential edge (6) of the first or second major surface of the cover lens (4) and at the outer fastening region (19) via the at least one of a sealant and adhesive (16) to an edge (2) of the opening of the housing (1).

* * * * *